United States Patent [19]

Leuthold et al.

[11] Patent Number: 5,039,020

[45] Date of Patent: Aug. 13, 1991

[54] METHOD AND APPARATUS FOR AUTOMATICALLY MONITORING THE DESTRUCTION OF THIN SHEET MATERIAL

[75] Inventors: Karl Leuthold, Munich; Wilhelm Hell, Mering; Mümtaz Ertürk, Munich, all of Fed. Rep. of Germany

[73] Assignee: GAO Gesellschaft für Automation und Organisation mbH, Fed. Rep. of Germany

[21] Appl. No.: 454,079

[22] Filed: Dec. 21, 1989

[30] Foreign Application Priority Data

Dec. 23, 1988 [DE] Fed. Rep. of Germany ..... 3843602

[51] Int. Cl.[5] ..... B02C 25/00

[52] U.S. Cl. ..... 241/30; 241/100; 241/236

[58] Field of Search ..... 241/30, 236, 34, 35, 241/36, 37, 33, 100, 101.2

[56] References Cited

U.S. PATENT DOCUMENTS

| | | | |
|---|---|---|---|
| 3,724,766 | 4/1973 | Bosland | 241/36 X |
| 4,597,535 | 7/1986 | Fontanille | 241/35 X |
| 4,709,197 | 11/1987 | Goldhammer et al. | 241/36 X |
| 4,793,561 | 12/1988 | Burda | 241/36 |

FOREIGN PATENT DOCUMENTS

| | | | |
|---|---|---|---|
| 2759678 | 2/1982 | Fed. Rep. of Germany . | |
| 3706623 | 9/1988 | Fed. Rep. of Germany | 241/36 |
| 475421 | 11/1937 | United Kingdom | 241/36 |

*Primary Examiner*—Mark Rosenbaum

*Attorney, Agent, or Firm*—Andrus, Sceales, Starke & Sawall

[57] ABSTRACT

The invention relates to a method and apparatus for monitoring the destruction of thin sheet material, in particular bank notes, in an automatic sorting machine, whereby the sheet material is fed by a transport means successively sheet by sheet to a motor-driven cutting means having meshing cutter boards. The destruction process and/or its immediate result are detected by sensor means.

22 Claims, 3 Drawing Sheets

Figure 1:
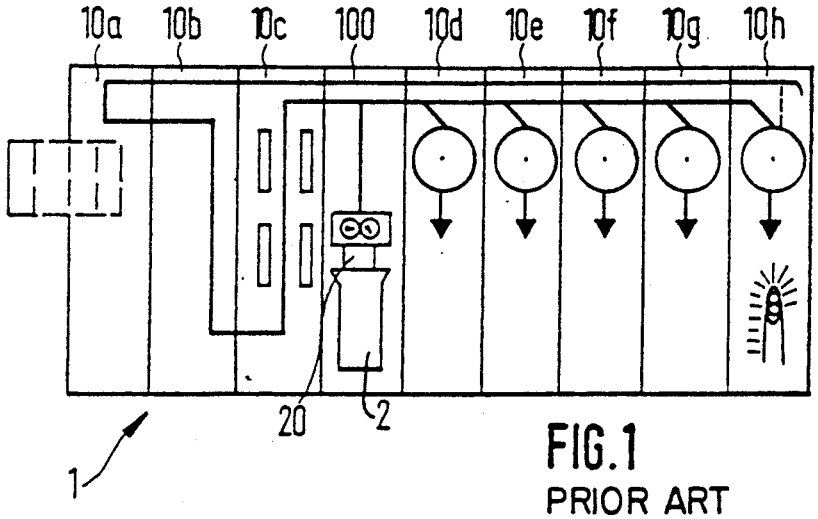
FIG.1 PRIOR ART

METHOD AND APPARATUS FOR AUTOMATICALLY MONITORING THE DESTRUCTION OF THIN SHEET MATERIAL

The present invention relates to a method and apparatus for monitoring the destruction of thin sheet material, in particular bank notes in an automatic sorting machine, whereby the sheet material is fed by a transport means successively sheet by sheet to a motor-driven cutting means having meshing cutter blocks.

Damaged, worn, soiled or otherwise useless bank notes are sorted out of the circulation of money and destroyed. This is performed increasingly using automatic bank note sorting machines for sorting out bank notes unfit for circulation, among other things. The bank notes unfit for circulation must be destroyed. For this purpose they are cut into small strips in a cutting or shredding machine and, in some cases, additionally shredded by cross cutting.

It is basically possible to destroy the bank notes unfit for circulation, that are rejected automatically in the bank note sorting machine, in a separate place in a separate cutting or shredding machine. However, it must be ensured that no bank note can be removed during the transportation of the rejected bank notes to the cutting means.

It is safer to destroy the bank notes immediately within the bank note sorting machine. This is referred to as on-line operation or on-line destruction in the machine. The advantage of this on-line method is that manipulation is virtually impossible, i.e. no rejected bank notes can be removed in any way.

Whereas it is possible to count the bank notes unfit for circulation beforehand when they are destroyed separately from the bank note sorting machine, one must ensure an exact counting of the destroyed bank notes in the case of on-line operation, i.e. if bank notes unfit for circulation are destroyed within the machine.

German patent No. 27 59 678 shows an apparatus for automatically destroying bank notes rejected in an automatic sorting machine, wherein a light barrier is disposed before the cutting means to monitor destruction and count the destroyed bank notes. The bank notes classified as unfit for circulation reach the cutting means via a branch of the transport means, whereby they pass the light barrier shortly before running into the cutting means. The known machine and also the known method for monitoring destruction have proved useful but it has turned out that false counts can come about to certain sources of error.

To allow for a complete count of the bank notes running into the cutting means, the light barrier must be disposed as close as possible before the cutter blocks of the cutting means. This prevents a bank note running past the light barrier from being branched off or picked out before the cutter blocks. However, the closeness of the light barrier and the cutter blocks leads to fast soiling of the light barrier, since each individual cutting operation produces a considerable amount of shreds and dust. Unless cleaning is performed within extremely short intervals, the functioning of the light barrier is impaired.

Although the light barrier is disposed relatively close before the cutter blocks of the cutting means there is still, for constructional reasons, a certain distance between the run-in gap of the cutter blocks, on the one hand, and the light barrier, on the other hand. It has been observed that in particular very limp bank notes or bank notes with folded leading edges or dog-ears tend to roll up before the cutter blocks rotating in opposite directions, so that they are not destroyed although they are properly counted.

If a bank note partly rolls up before the cutter blocks, the trailing part of the bank note can also stop before the light barrier like a flag. Since the light barrier in this case does not report the proper pass of a bank note in time, an emergency stop of the machine is occasioned in the interests of a reliable count. Since the cutter blocks continue to run for a while due to the mass moment of inertia of their moving parts, other rejected bank notes might possibly pass into the cutting means and either get stuck before the cutter blocks together with the partly rolled bank note or pass through the shredder means with the partly rolled bank note. In any case, the following bank notes are not properly counted by the light barrier since the light barrier is put out of operation by the partly rolled bank note before the cutter blocks.

In order to avoid a bank note jam in the area of the cutting means, the speed at which the bank notes are drawn into the cutting means is set so as to be slightly greater in the speed at which the bank note is transported to the cutting means. The bank notes running into the cutting means are briefly accelerated while the trailing portion of the bank note is still located in the transport system. If the bank note tears, the light barrier might report two events, i.e. incorrectly report two passing bank notes, although only the two parts of one torn bank note passed.

The invention is based on the task of providing a method and apparatus for monitoring the destruction of thin sheet material whereby individual sheets are detected, and thus the sheets intended for destruction are counted, with greater accuracy.

This task is achieved by the features recited in the appended claims.

The basic idea of the invention is to monitor the destruction of a bank note with suitable sensor means, whereby the destruction process itself or its immediate consequence is detected.

The operation of destruction itself can be detected by sensors that detect changes in the electrical or mechanical behavior of the shredder means, or by suitable detectors that monitor the typical shredder noise arising during destruction. Along with these possibilities, one can also detect the immediate result of destruction using sensors that detect the cut sheet material leaving the cutting means and forming a kind of "shred cloud" directly behind the cutting means, in the direction of transport.

In all these methods, which can be used alone or in combination, only the actually destroyed bank notes are detected. Furthermore, none of these methods involves the danger of soiling, so that corresponding servicing work is unnecessary or reduced to the usual extent. If a sensor signal is detected one can reliably assume that the bank note was destroyed. The time at which a bank note should run into the cutting means can be exactly determined due to the geometry of the transport system and the transport speed. If the sensor signal does not occur one can react very quickly by stopping the machine. Rolled notes are recognized in time. The probability of further notes running into the shredder is much smaller.

The inventive solution allows for bank notes intended for destruction to be counted in a way that is almost free from servicing, unsusceptible to trouble and very reliable. In addition to the counting function, however, the inventive solution also allows for other statements to be made, for example on the bank note length, the bank note quality and the multiple pass of bank notes. The sensor signals produced by the sensor means used have a certain duration, intensity and also a certain amplitude curve depending on the bank note length, the quality of the destroyed bank note and the excess thickness caused by overlapping bank notes. One can thus, for example, recognize from the duration of the sensor signal whether one whole bank note or two parts of a torn bank note have been destroyed. Should several bank notes run into the cutting means in spite of the fast switch-off possibilities, it is also possible to make a statement on the number of shredded bank notes due to the characteristics of the sensor signal.

The inventively produced sensor signals can be correlated with other detector signals produced in other parts of the bank note sorting machine to further improve the reliability of the count and the evaluation of the aforesaid parameters of destroyed notes.

According to a development of the invention, the sensor signal can be correlated with the signal of a light barrier provided before the cutting means. The light barrier signal can be used to generate an expectation window in which the sensor signal must appear in the case of proper functioning. The light barrier can be disposed at a sufficient distance from the cutter blocks, which protects it from being soiled.

Figure 2:
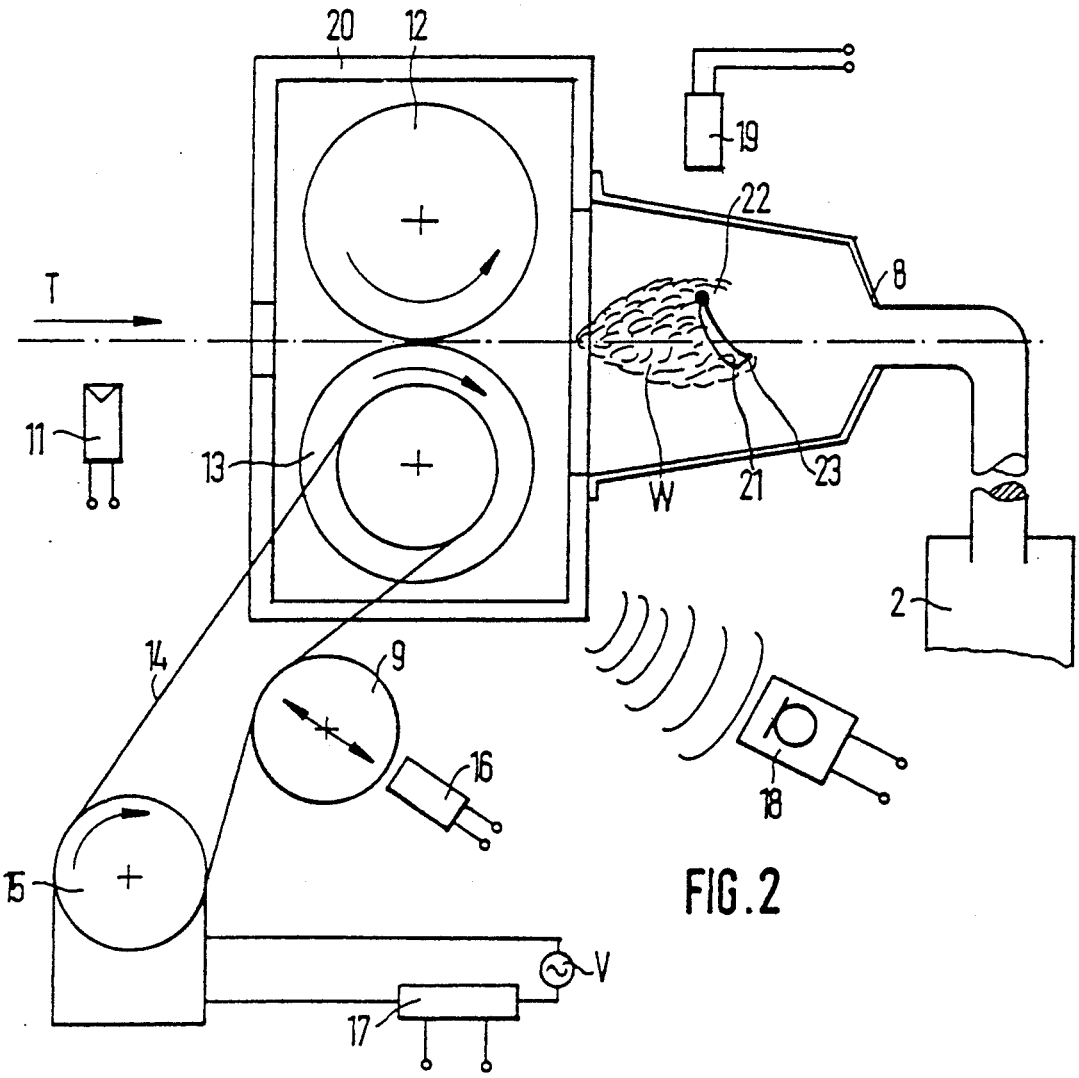
Figure 3:
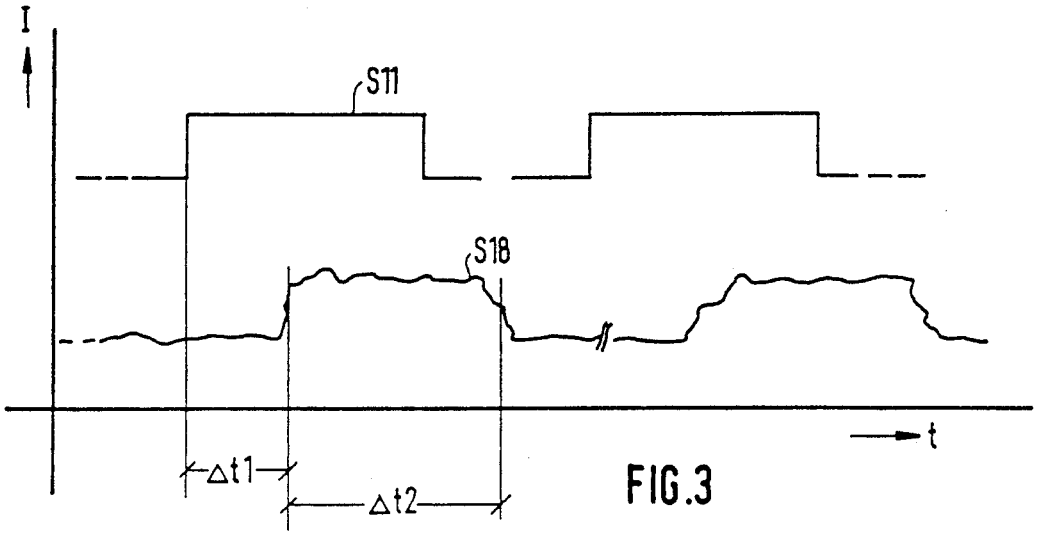
Figure 4:
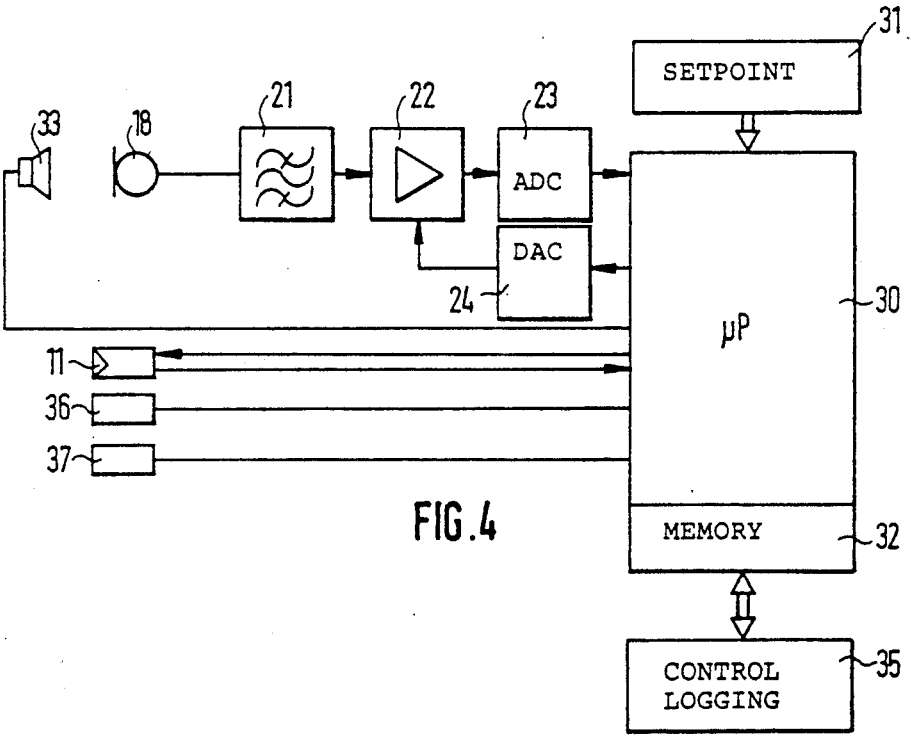
Figure 5:
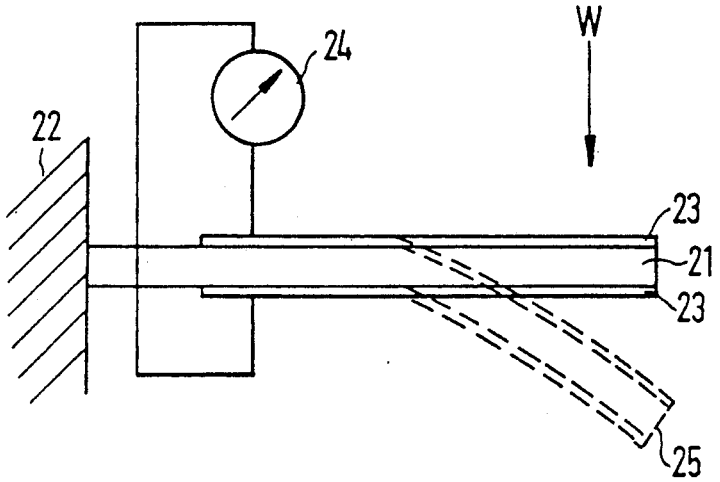

Further advantages and developments of the invention can be found in the following exemplary embodiment of the invention explained with reference to the figures, in which FIG. 1 shows a schematic view of a known automatic bank note sorting machine having an integrated apparatus for automatically destroying bank notes unfit for circulation, FIG. 2 shows a schematic view of an apparatus of the invention for destroying bank notes unfit for circulation, combining various embodiments, FIG. 3 shows a pulse diagram to illustrate the processing of the signals obtained with the arrangement of FIG. 2, FIG. 4 shows a block diagram of a control and evaluating circuit for the means of FIG. 2, and FIG. 5 roughly shows the mode of functioning of a piezoelectric film.

The invention can be used in general for sheetlike material, but is to be used in particular in automatic bank note sorting machines. The embodiment described below relates to such a machine as is shown in general in FIG. 1 (cf. also German patent No. 27 59 678).

According to FIG. 1, this known automatic bank note sorting machine 1 comprises a plurality of modules 10*a*, 10*b*, 10*c*, 100, 10*d*–10*h*. In module 10*a* the packets of bank notes arriving in magazines are debanded. In module 10*b* the bank notes are singled. Module 10*c* is for testing, for instance, whether the bank notes are damaged, worn, soiled or otherwise unsuitable for further circulation. Bank notes unfit for circulation can be destroyed in module 100. Module 100 contains a cutting means 20 to which the bank notes unfit for circulation are successively fed. Cutting means 20 contains two meshing cutter blocks that run in opposite directions and cut each individual bank note lengthwise. Cutting means are also known which cut bank notes lengthwise and crosswise. In any case the shreds pass, optionally with the support of suction air, into a container 2, which may also be installed at a distance from the machine. Alternatively, bank notes unfit for circulation can also be deposited by tandem operation in subsequent modules 10*d* and 10*e*. In modules 10*f* and 10*g* bank notes fit for circulation are stacked and banded. In the last module 10*h* bank notes are collected which must be finished by hand.

The bank notes shredded in module 100 must be counted by a very reliable method since the shreds themselves do not allow for any conclusions to be drawn on the number of destroyed bank notes. It is therefore necessary to detect each individual cutting or destroying operation exactly.

FIG. 2 shows an exemplary embodiment of details of cutting means 20 comprising a plurality of sensors which may be provided singly or in any combination for detecting the destruction of a bank note or the direct result of destruction.

According to FIG. 2, individual bank notes are introduced along a transport path T in the direction in the arrow through a slot into a housing of cutting means 20. At a distance from cutting means 20 large enough to avoid soiling, a light barrier 11 is disposed on transport path T for registering the bank notes passing through. Cutting means 20 comprises two meshing cutter blocks 12 and 13 which are rotated in opposite directions, as shown by the arrows. The two cutter blocks are driven via a transmission belt 14 by an electromotor 15.

A first sensor means for producing a signal representing the destruction of a bank note detects the elevated mechanical stress occurring during the cutting operation. In the embodiment shown, this is done by proximity calipers 16 which register the deflection of a tension roller 9. When cutter blocks 12 and 13 rotate idly, i.e. without a bank note between them, transmission belt 14 has a certain tension. When a bank note comes between cutter blocks 12 and 13, this increases the mechanical stress acting on the cutter blocks, thereby increasing the tension of transmission belt 14. This moves tension roller 9 toward proximity calipers 16 which produce a corresponding signal. A similar signal can be determined on all system components subjected to the elevated mechanical stress using suitable sensors (displacement-acceleration transducers or force transducers).

When a bank note runs through cutter blocks 12 and 13, this also increases the moment acting as a load moment on electromotor 15, so that electromotor 15 connected to a power source V draws more current. This increased power consumption is detected by a current sensor 17 which produces a signal representing the increased power consumption of motor 15. Such sensors are available as finished components.

This second sensor for detecting the operation of destroying a bank note can of course also be used if electromotor 15 is directly coupled with the cutter blocks. The signal obtained via the current change is the more informative, the smaller the kinetic energy is that exists due to the moving masses and more or less reflects mechanical stress during shredding. The described method is thus preferably used when the kinetic energy of the system is low.

A further possibility of detecting the destruction process by sensors is to evaluate the noise occurring during each cutting operation.

This noise is detected by a microphone 18 and converted into a corresponding electrical signal. Microphone 18 can be coupled via air or else directly with the housing of the cutting means so as to pick up the structure-borne noise.

Depending on the construction of the cutting means and the influence of interference noises from the machine and the surroundings, one will select the appropriate mode of coupling. In some cases the entire cutting means may also be decoupled acoustically from the sorting machine by a corresponding mount. Acoustic monitoring will preferably be used when the kinetic energy present in the system is relatively high, so that a signal obtained via the above-described current change would not have the desired information value.

One can detect not only the destruction process but also the destroyed sheet material behind the shredder blocks using suitable detectors.

Especially in the case of lengthwise and crosswise cutting means supported by suction air, each destroyed bank note forms a cloud W of dust and shreds after leaving cutter blocks 12 and 13. The area in which the cloud forms can be monitored, for example, by an optical sensor 19, whereby the sensor is disposed outside a housing 8 transparent to sensor radiation. Other sensors, for example ultrasound sensors, are also suitable for detecting the shred cloud.

Another possibility of monitoring is to use piezoelectric materials, in particular piezoelectric films, which are characterized by special electrical properties. The external action of force or deformation causes surface charges of different polarities, which can be detected by measuring techniques, to arise on opposite surfaces of such a material. This voltage occurs only upon a change of force. If the action of force is constant, the voltage signal goes back to the value 0 with a certain time constant, as in a capacitor. A negative action of force of the same value causes a voltage pulse of opposite polarity.

A known representative of such piezoelectric films is polyvinylidene fluoride (PVDF) from Pennwalt Piezo Film Ltd. (Great Britain), a long-chain semicrystalline polymer of CH 2-CF 2. FIG. 5 shows the simplest embodiment of such a piezo film for use as a sensor. Both surfaces of piezo film 21 are given a complete metal coating 23. The change in surface charge density caused by deformation or bending can be measured as voltage between the metal areas by measuring device 24 or further processed for the corresponding purposes.

Other more complicated embodiments of such piezo films and their evaluation by measuring techniques are described in the article by J. Victor Chatigny (Medical Electronics Sept. 1988, 90).

Piezo films have the advantage that they work in a wide frequency range (1 . . . 10 MHz) and have a wide dynamic range in sensitivity. This sensitivity in converting mechanical deformation into electrical signals ranges from the lightest contact to the monitoring of material destruction. A further essential feature is the low production and processing cost of these films.

FIG. 2 shows the inventive use of a piezoelectric film its simplest embodiment. Film 21 is attached behind shredder blocks 22 in the manner of a flag in accordance with the local conditions in such a way that shred cloud W resulting from the shredding of bank notes hits the piezo film. The shower of bank note shreds W deforms the film in the way indicated by 25 in FIG. 5, thereby inducing voltage between electrodes 23. This voltage pulse is processed by measuring electronics 24. In this way the analogue signal of the film, for example, can be processed and compared with the signal from light barrier 11 (FIG. 2) before the shredder blocks, in order to ensure that each individual bank note has actually passed through the shredder.

For all the above-mentioned sensor signals, the simplest form of evaluation is to compare the sensor signal with a suitable threshold once or several times via the signal pattern. If the sensor signal exceeds the threshold a corresponding counter is increased by one. The comparing operation can be initiated by the leading edge of the sensor signal. Suitable thresholds can also be used to make statements on destroyed notes, on double or multiple notes, on the length of the destroyed note and on its quality.

All stated methods ensure a very reliable counting function. If more detailed statements are desired, for example on the bank note quality, one will select the most suitable method for this purpose. For example, the acoustic signal is preferably used if statements on the quality of the note are desired. A bank note that is in relatively good condition and still stiff produces a different noise to a worn, limp note. Using suitable analyzing methods (e.g. frequency analysis) one can make statements on the quality of the destroyed note.

FIGS. 3 and 4 illustrate further details of evaluation by the example of acoustic monitoring. The acoustic signal is correlated here with a light barrier signal, among other things.

FIG. 3 shows the time curves of a rectangular pulse signal S11 produced by light barrier 11, and of a sensor signal S18 produced by microphone 18. Since light barrier 11 is spaced a certain distance from cutter blocks 12 and 13 and the bank note has a certain speed, there is a corresponding time delay $\Delta t1$ between the two front and back sides of signals S11 and S18. Depending on the transit speed and length of the bank note, signal S18 has a duration $\Delta t2$.

From light barrier signal S11 a so-called "expectation window" is generated in a control means. The leading edge of sensor signal S18 must appear in this window after time $\Delta t1$ in the case of proper operation. If the signal does not appear there is a disturbance. This evaluating method also automatically tunes out interference signals which are outside the expectation gate. A further expectation window can be generated in order to check time $\Delta t2$, which is proportional to the length of the destroyed bank note.

Signal S18 shown in FIG. 3 may alternatively be a signal produced by proximity calipers 16, a signal produced by current sensor 17 or a signal obtained from optical detector 19.

FIG. 4 shows a control and evaluating circuit whose essential component is a microprocessor 30 equipped with a memory 32. Setpoint signals can be inputted into this microprocessor via an input means 31. Microphone 18 is connected to microprocessor 30 via a band pass filter 21, a controlled amplifier 22 and an analog to digital converter 23. The amplification of amplifier 22 can be adjusted by microprocessor 30 via a digital to analog converter 24. The signal picked up by microphone 18 is filtered, amplified and converted to a digital value and then appropriately processed in microprocessor 30, as already mentioned, being correlated with the light barrier signal.

To check and adjust the functioning of microphone 18 and the circuitry following it, microprocessor 30 provides a test signal to a loudspeaker 33 and evaluates the test signal picked up by microphone 18. Corrections are fed to amplifier 22 via digital to analog converter 24.

Microprocessor 30 is connected to a unit 35 which is responsible for, among other things, controlling the sorting machine and logging the detected data. Unit 35 therefore has access to a part of memory 32 in which the results for the particular destroyed notes are stored depending on the number of evaluated parameters. These are, for example, the number of destroyed notes, information on length, quality and multiple passage.

The microprocessor can also be connected with a sensor 36 which permanently monitors the rotating speed of the shredder blocks. This information can be used to improve the determination of the length of a destroyed note. Signals from condition sensors 37 present in the sorting machine can also be fed to the microprocessor in order to include the results of these sensors in the evaluation of the quality of a destroyed note.

Finally, light barrier 11 can be used to obtain additional information which can also be included in the evaluation of the acoustic signal. If light barrier 11 detects the leading edge of a bank note, microprocessor 30 provides an elevated current signal to light barrier 11 so that the latter can be operated virtually as a transmitted light sensor. If a plurality of bank notes pass the light barrier, the light shining through is dampened to a greater degree and the amplitude of the signal becomes accordingly weaker.

We claim:

1. A method for monitoring the destruction of thin sheets of material, including bank notes, in an automatic sorting machine, said method providing an accurate count of the number of sheets destroyed and confirmation that destruction of the sheets has, in fact, occurred, said method comprising the steps of:

successively feeding the sheets to a motor-driven cutting means having meshing cutter blocks;

sensing the feeding of the sheets to the cutting means;

generating a passage signal responsive to the feeding of a sheet to the cutting means;

destroying the sheet by passing same through the meshing cutter blocks of the cutting means;

detecting at least one aspect of the destruction of the sheet;

generating a destruction signal responsive to the destruction of the sheet; and correlating the destruction signal generated by the destruction of a given sheet with the passage signal generated by the same sheet to ascertain that destruction of the given sheet has occurred.

2. The method of claim 1 wherein generation of said passage signal is further defined as establishing a predetermined period of time and wherein said correlating step is further defined as determining whether said destruction signal occurs during said predetermined period of time.

3. The method of claim 2 further defined as one for monitoring the destruction of sheets having predetermined length properties, wherein the generation of said passage signal is further defined as establishing a second predetermined period of time in accordance with the length properties of a given sheet and wherein the step of correlating the destruction and passage signals is further defined as determining whether the destruction signal generated by the destruction of the given sheet occurs during the second predetermined period of time to ascertain the length properties of the destroyed given sheet.

4. The method according to claim 2 further defined as one for providing information about the characteristics of at least one of the destruction process and the material sheets being destroyed, said method further including the step of analyzing the properties of the destruction signal to ascertain the desired information.

5. The method according to claim 4 further defined as one for use in an automatic sorting machine having a sensor providing data with respect to the material sheets and wherein the analyzing step is further defined as using data from said sensor to provide information about the characteristics of the material sheets being destroyed.

6. The method according to claim 1 wherein the cutting means is driven by an electrical motor and wherein the step of generating the destruction signal is further defined as generating a signal in accordance with the electrical load characteristics of the motor.

7. The method according to claim 1 wherein the step of generating the destruction signal is further defined as detecting mechanical loading occurring in said cutting means and generating a signal responsive to such mechanical loading.

8. The method according to claim 1 in which noise is produced by the destruction process and wherein the step of generating the destruction signal is further defined as detecting the noise of the destruction process and generating a signal responsive thereto.

9. The method of claim 1 wherein the generation of the destruction signal is further defined as generating the destruction signal responsive to the discharge of destroyed sheet material from the cutting means.

10. The method of claim 9 further defined as optically detecting the discharge of destroyed sheet material and generating the destruction signal.

11. The method of claim 9 further defined as ultrasonically detecting the discharge of destroyed sheet material and generating the destruction signal.

12. The method according to claim 9 further defined as generating the destruction signal by deflecting a piezoelectric element with the cut sheet material discharged from the cutting means.

13. Apparatus for automatically destroying thin sheets of material, including bank notes, said apparatus providing an accurate count of the number of sheets destroyed and confirmation that destruction of the sheet has, in fact, occurred, said apparatus comprising:

motor driven cutting means having meshing cutter blocks to which the sheets to be destroyed are fed singly in succession in a transport direction;

first sensor means disposed upstream of said cutter blocks in said transport direction for generating a passage signal responsive to the feeding of a sheet to said cutting means;

second sensor means for generating a destruction signal responsive to the destruction of a sheet; and means for correlating the destruction signal resulting from the destruction of a given sheet with the passage signal generated by the same sheet to ascertain that destruction of the given sheet has occurred.

14. The apparatus of claim 13 wherein said correlating means comprises a microprocessor.

15. The apparatus of claim 13 wherein said first sensor means comprises a light sensor.

16. The apparatus of claim 13 wherein the cutting means is driven by an electric motor and wherein said second sensor means comprises sensor means coupled to the motor for detecting the current drawn by the motor.

17. The apparatus of claim 13 wherein said second sensor means comprises sensor means for detecting mechanical stress occurring in the cutting means as a result of the destruction of a sheet.

18. The apparatus of claim 13 wherein said second sensor means comprises a sound transducer for detecting noise occurring during the destruction of a sheet.

19. The apparatus of claim 13 wherein said second sensor means comprises means for detecting cut sheet material discharged from the cutting blocks.

20. The apparatus of claim 19 wherein said second sensor means comprises one of an optical sensor, ultrasonic sensor, and piezoelectric sensor.

21. The apparatus of claim 20 wherein said second sensor means comprises a piezoelectric sensor formed of a piezoelectric film.

22. The apparatus of claim 13 wherein the apparatus is operatively associated with an automatic sorting machine for the sheets, said sorting machine having a sensor providing data with respect to the material sheets and wherein said correlating means is coupled to said sorting machine sensor for determining information regarding the sheets being destroyed.

* * * * *